US007918167B2

(12) United States Patent
Tanielian et al.

(10) Patent No.: US 7,918,167 B2
(45) Date of Patent: Apr. 5, 2011

(54) EXTREMELY RAPID REVERSIBLE BARRIER AND FORMATION METHOD

(75) Inventors: Minas H. Tanielian, Bellevue, WA (US); Thomas A. Woodrow, Issaquah, WA (US)

(73) Assignee: The Boeing Company, Chicago, IL (US)

( * ) Notice: Subject to any disclaimer, the term of this patent is extended or adjusted under 35 U.S.C. 154(b) by 1337 days.

(21) Appl. No.: 11/133,817

(22) Filed: May 20, 2005

(65) Prior Publication Data

US 2006/0260210 A1 Nov. 23, 2006

(51) Int. Cl.
*E06B 5/12* (2006.01)
*E06B 5/10* (2006.01)

(52) U.S. Cl. ..... 109/49.5; 89/36; 102/303; 52/2.11; 52/2.13; 52/2.17; 52/745.06; 410/119

(58) Field of Classification Search ..... 52/2.11, 52/2.13, 2.17, 2.19, 2.22, 202, 203, 514, 52/745.05, 745.06, 741.3, 745.19, 1; 109/49.5; 102/303; 410/119, 118; 49/9, 501; 89/36.17
See application file for complete search history.

(56) References Cited

U.S. PATENT DOCUMENTS

| | | | | | |
|---|---|---|---|---|---|
| 2,669,402 | A | | 2/1954 | Del Mar | |
| 3,256,539 | A | * | 6/1966 | Clark | 441/21 |
| 3,300,910 | A | * | 1/1967 | Isaac | 52/2.19 |
| 3,364,632 | A | * | 1/1968 | Isaac | 52/2.22 |
| 3,426,891 | A | * | 2/1969 | Marks | 410/119 |
| 3,486,723 | A | | 12/1969 | Harrison | |
| 3,491,847 | A | * | 1/1970 | Abbott | 180/271 |
| 3,667,625 | A | * | 6/1972 | Lucas | 410/119 |
| 4,198,454 | A | * | 4/1980 | Norton | 428/117 |
| 4,566,831 | A | * | 1/1986 | Groth | 410/117 |
| 4,589,341 | A | * | 5/1986 | Clark et al. | 102/303 |
| 4,782,735 | A | * | 11/1988 | Mui et al. | 89/36.07 |
| 4,892,210 | A | | 1/1990 | Kupersmit | |
| 5,076,168 | A | * | 12/1991 | Yoshida et al. | 102/303 |
| 5,184,727 | A | * | 2/1993 | Dickie et al. | 206/522 |
| 5,249,534 | A | * | 10/1993 | Sacks | 109/24 |
| 5,676,509 | A | * | 10/1997 | Enzu | 410/119 |
| 5,699,820 | A | * | 12/1997 | Evans et al. | 135/96 |

(Continued)

OTHER PUBLICATIONS

Johnson, T. Apr. 21, 2004. Army scientists, engineers develop liquid body armor. Army News Service. http://www.military.com/NewsContent/0,13319,usa3_042104.00.html (Feb. 13, 2005).

*Primary Examiner* — Phi Dieu Tran A
(74) *Attorney, Agent, or Firm* — Harness, Dickey & Pierce, P.L.C.

(57) ABSTRACT

Barriers and methods of obstructing apertures. One embodiment provides a temporary barrier that includes a bag, a fluid source, and a shear thickening fluid. The bag is made of fabric and can expand (e.g. inflate) via the fluid source which is in communication with the bag. The shear thickening fluid permeates the fabric of the bag and has two states. In the first state the shear thickening fluid allows the fabric to be flexible. In the second state the shear thickening fluid causes the fabric to be inflexible. To cause the shear thickening fluid to transition to the second state a shear must be present in the shear thickening fluid. A material that is capable of reacting to form a gas may be in communication with the fluid source to provide a gas to expand the bag. A deflation valve may also be included in the barrier.

15 Claims, 8 Drawing Sheets

U.S. PATENT DOCUMENTS 5,719,350 A * 2/1998 Parkes et al. ..... 102/303
5,730,564 A * 3/1998 Howlett, Jr. ..... 410/119
5,772,371 A 6/1998 Ackerman
5,806,572 A * 9/1998 Voller ..... 141/10
5,813,172 A * 9/1998 McNally ..... 52/2.25
5,833,413 A * 11/1998 Cornelius ..... 410/119
5,848,864 A 12/1998 Selby
5,915,652 A 6/1999 Caldwell et al.
6,010,286 A 1/2000 Cross et al.
6,033,167 A * 3/2000 Bourgeois ..... 410/119
6,161,462 A * 12/2000 Michaelson ..... 89/36.01
6,192,633 B1 * 2/2001 Hilbert ..... 52/2.18
6,200,664 B1 * 3/2001 Figge et al. ..... 428/178
6,217,268 B1 4/2001 Chou
6,240,858 B1 * 6/2001 Mandall ..... 109/49.5
6,302,026 B1 * 10/2001 Parkes ..... 102/303
6,412,391 B1 * 7/2002 Stevens et al. ..... 89/36.17
6,435,786 B1 8/2002 Breckel et al.
6,702,533 B1 * 3/2004 Williams et al. ..... 410/118
6,708,927 B2 * 3/2004 Chen ..... 244/143
7,007,307 B2 * 3/2006 Takeuchi ..... 2/102
7,146,665 B1 * 12/2006 Moorin ..... 5/644
7,523,956 B2 * 4/2009 Zumpano ..... 280/730.1
2006/0192367 A1 * 8/2006 Zumpano ..... 280/730.1
2006/0234577 A1 * 10/2006 Wagner et al. ..... 442/135

* cited by examiner

EXTREMELY RAPID REVERSIBLE BARRIER AND FORMATION METHOD

FIELD OF THE INVENTION

This invention relates generally to barriers and, more particularly, to temporary barriers for obstructing and sealing an aperture leading to an enclosed area.

BACKGROUND OF THE INVENTION

Many emergency situations, and even many non-emergency situations, create a need to rapidly block-off, obstruct, or seal an opening in, or between, structures. For instance, during urban combat or law enforcement activities a route may need to be blocked to prevent an attack by opposing forces, the escape of the opposing forces or the flight of a suspect. These routes are typically characterized by choke points such as narrow alleys or streets, pre-existing openings through structures (e.g., windows or doors), and breaches of the structure (e.g., openings created by an explosive device). Because conditions in the field can change rapidly and because the forces may move about in the field, it therefore becomes desirable to erect the barrier rapidly. Similarly, once the need for the barrier passes it is often desirable to reopen the route so that other activities involving the chokepoint are not unduly hindered.

While many of these situations occur outdoors, many indoor situations also create a desire to obstruct a choke-point or other passageway. For instance, the release of a chemical in an indoor setting (e.g. a manufacturing facility) may cause a desire to seal the area of the facility in which the release occurred. Similarly, a fire or explosion may make it desirable to prevent the outflow of combustion products, and the in flow of air or combustible materials such as natural gas, grain dust, and the like.

SUMMARY OF THE INVENTION

In a first preferred embodiment, the present invention provides a temporary barrier that includes a bag, a fluid source, and a shear thickening fluid. The bag is made of fabric and can expand (e.g. inflate). A material (e.g. a mixture of sodium azide and potassium nitrate) that is capable of reacting to form a gas may be in communication with the fluid source to inflate the bag and, preferably, to cause the bag to seal against a portion of a building. A deflation valve may also be included in the barrier to deflate the bag to a size in which the bag can fit in a backpack. A shear thickening fluid permeates the fabric of the bag and has two states. In the first state, the shear thickening fluid allows the fabric to be flexible. In the second state, the shear thickening fluid causes the fabric to be inflexible. To cause the shear thickening fluid to transition to the second state, a shear must be present in the shear thickening fluid.

In a second preferred form, the present invention provides a method of obstructing an aperture. In the method, a fabric bag is placed near the aperture and expanded with a fluid to obstruct the aperture. Preferably, the bag is expanded using the gas produced by the reaction of a mixture of sodium azide and potassium nitrate. Further, the bag may seal against a structure that defines the aperture to prevent air from reaching a fire. A spray on foam may also be used to aid the bag in sealing against the structure. Additionally, a shear is allowed to act on the bag (because, for example, a bullet or other projectile collides with the bag) in such a manner that at least a portion of a shear thickening fluid transitions from a first state in which the shear thickening fluid allows at least a portion of the fabric to be flexible and a second state in which the shear thickening fluid causes the fabric to be inflexible. The bag may also be collapsed (or deflated) and carried in a backpack.

In a third preferred embodiment, the present invention provides a system that includes a temporary barrier, a fluid source, and a sensor. The temporary barrier further includes an inflatable fabric bag that is permeated with a shear thickening fluid. The sensor is in communication with the fluid source. If the sensor senses an unsafe condition (e.g., a fire) it, in conjunction with an actuator, causes the fluid source to expand the bag. Preferably, the system includes a storage location for the bag that is near an aperture of the building so that when the bag expands it obstructs the building aperture.

Further features and advantages of the present invention, as well as the structure and operation of various embodiments of the present invention, are described in detail below with reference to the accompanying drawings.

BRIEF DESCRIPTION OF THE DRAWINGS

The accompanying drawings, which are incorporated in and form a part of the specification, illustrate exemplary embodiments of the present invention and together with the description, serve to explain the principles of the invention. In the drawings.

DETAILED DESCRIPTION OF THE PREFERRED EMBODIMENTS

Figure 1:
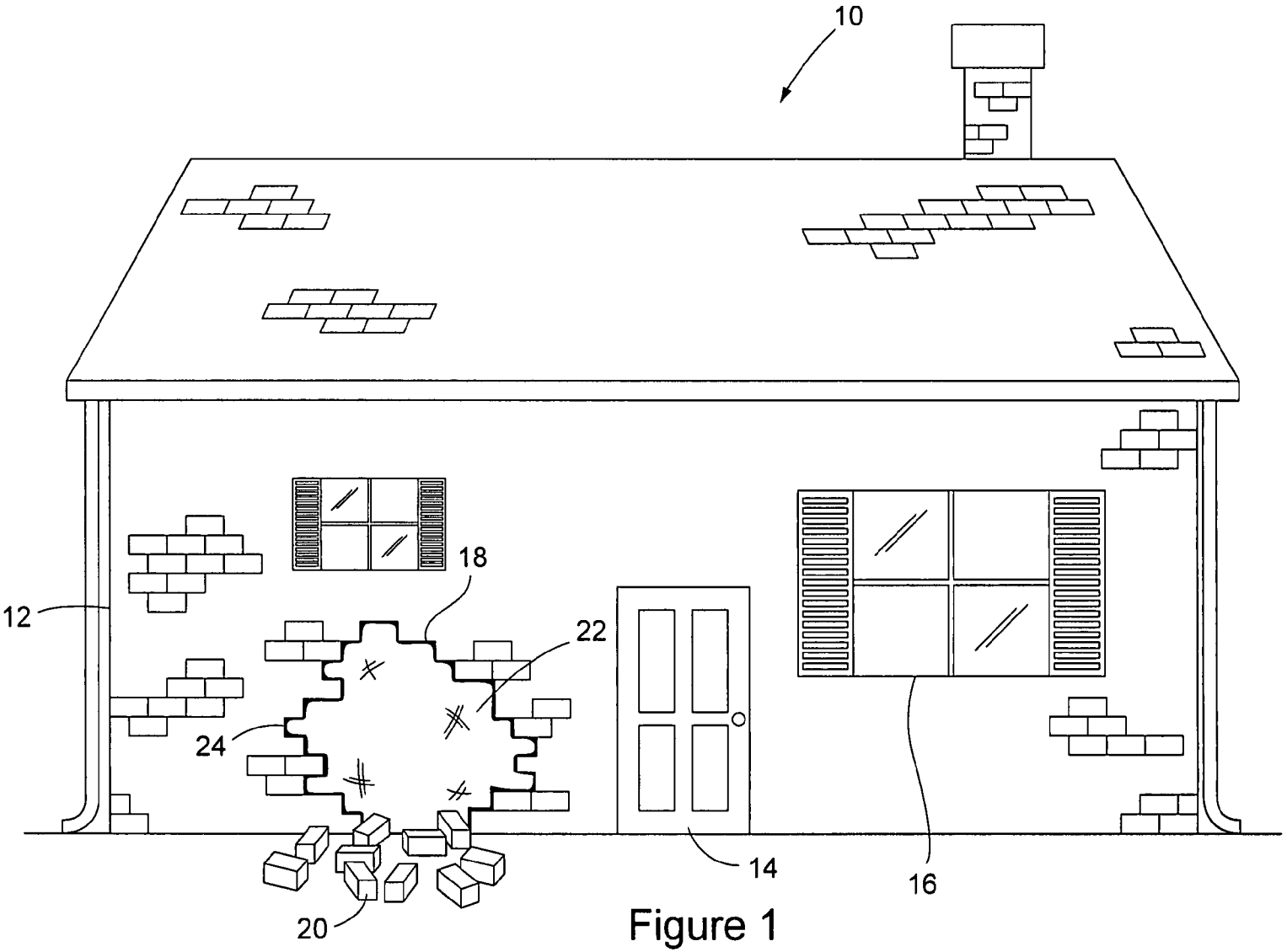
FIG. 1 illustrates a barrier constructed in accordance with the principles of the present invention.

It is often desirable in many hazardous material (e.g., a chemical, biological, or radiological material) releases, firefighting, and other emergency situations to be able to rapidly seal a corridor, a door, or various openings to either isolate a threat, such as a chemical spill or biological agent. In many of these situations it is also desired to establish an airtight seal while in other situations merely blocking the opening is desired. For instance, in some firefighting scenarios, it may be valuable to isolate a fire and perhaps extinguish it by limiting the air supply that is allowed to flow through the opening. It may also be beneficial to stop smoke from spreading by sealing corridors, ducts, and other ventilation routes. Similarly, military and law enforcement needs exist for a way to rapidly isolate a section of a corridor, portal, entrance, window, or door for a variety of reasons, such as for isolating enemies or hostile forces, safeguarding the area, impeding the movement of enemy force, or temporarily sealing an area that has important evidence, hardware, or weapons caches.

To be effective in rapidly developing situations, the barrier can be erected quickly and, preferably, in a minute or less without needing cumbersome materials, tools, or sub-assemblies. After the barrier is erected, it is also desirable that the creation of the barrier be rapidly reversed by the personnel who originally created the barrier and not those whom the barrier was intended to impede (e.g. enemy forces). Lightweight materials are also preferred so that the barrier can be carried conveniently by one person and, preferably, in a backpack. Further, because others might be interested in destroying the barrier it must be capable of withstanding violent physical attacks. Kevlar® is well suited for such applications (in part because Kevlar can be formed into bullet proof articles), although Neoprene, Vectran®, and other materials can be used to form the bag. Such a barrier could be useful in large buildings (in the case of fire) and it could even be part of a safety system that is pre-installed, or retrofitted, into the building. It could also be used as an emergency measure in fighting a threat. Thus, the barrier can supplement existing sprinkler and other fire extinguishing systems (e.g. Halon systems). In the alternative, the barriers of the present invention could be deployed in a street, alley, or other outside area to impede the progress of a vehicle (e.g. a light truck).

In accordance with the principles of the present invention, a temporary barrier is provided in a preferred embodiment that includes an airbag-like system. An airtight seal between the airbag and the structure that defines the portal can be formed using, for example, a spray-on polyurethane foam such as Great Stuff (available from the Dow Chemical Company of Midland, Mich.). Of course, the sealant can be chosen with the particular needs (e.g. material compatibility or exposure to extreme weather) of a given situation in mind. Further, because the barrier may be placed in a hazardous area it is preferred that the sealant come in, or be dispensed from, a container that allows the user to remain safe while applying the sealant. For instance, a sealant container with a hose or other long applicator is preferred.

The barriers provided by the present invention can also be constructed in such a manner that they can resist penetration by bullets, knifes, ice picks, shrapnel, and other projectiles, and cutting or piercing devices. These capabilities are provided in one preferred embodiment by permeating the fabric of the bag with a shear thickening fluid that is held in place by the fabric. Shear thickening fluids include hard particles suspended in a fluid and can exist generally in either of two states. The first state is characterized by low strain rates in the fluid whereby the particles move with the liquid. If the strain rate in the fluid is higher, the particles are no longer free to move with the fluid and instead form a temporary structure that resists the force that is causing the strain. Accordingly, in the first state the fabric remains flexible. But in the second state, the structure formed by the particles causes the fabric to become inflexible and therefore capable of resisting the object that is attempting to penetrate the fabric. Preferably, the shear thickening fluid includes nano scale particles of silica suspended in polyethylene glycol that permeates a Kevlar airbag. Thus, the resulting barrier is non-toxic and capable of withstanding a wide temperature range as well as other extreme weather and environmental conditions.

In addition to having the capability to be deployed and erected quickly, the barriers provided by the present invention may also be quickly disassembled and packed away. For instance, a valve can communicate with the airbag to allow the user to deflate the airbag with a simple opening of the valve (via electrical or mechanical actuators). Further, the controls for the valve may be driven by a radio frequency transmitter. In a preferred embodiment, the valve is controlled by an RFID (radio frequency identification) chip which is, in turn, controlled by the user via an RFID scanner or reader. The RFID chip on the bag can be actively powered (for example by using a battery) or passively powered in which case the RFID chip can include Helmholtz coils for drawing power from the radio frequency signal radiating from the scanner. Another preferred embodiment uses a subsystem that is similar to the controls of a remotely controlled garage door opener. In the current embodiment, a receiver on the bag receives commands transmitted from a handheld transmitter activated by the user. Further, the radio frequency subsystem can include provisions such that a unique code or frequency must be received for the receiver to inflate or deflate the barrier.

Another preferred embodiment provides a barrier system adapted for use outdoors and, more particularly, for blocking the egress of cars and trucks from narrow streets. Suitable airbags for such embodiments have been demonstrated to survive mechanical abuse (e.g. impact with the Martian surface at a speed on the order of 55 mph) in projects such as the recent Mars Lander project in which airbags were used to cushion the landing of the Mars rover. The barriers of the current embodiment can therefore be considerably larger than barriers adapted for merely obstructing a window (for example). Further, the current embodiment provides restraints such as cables or ropes to anchor the barrier to the ground or a nearby structure. One preferred restraint includes a Ramset™ system (available from Illinois Tool Works Inc. of Glenview, Ill.) that shoots nails into concrete to secure the barrier. In the alternative, the barrier can be adapted to wedge itself against nearby structures when the bag is inflated.

Referring to the accompanying drawings in which like reference numbers indicate like elements, FIG. 1 illustrates a barrier constructed in accordance with the principles of the present invention. FIG. 1 shows a structure 10 that includes a wall 12, a door 14, and a window 16 in the wall 12. Also shown is an opening 18 formed in the wall 12 by, for example, an explosive device. The pile of rubble 20 or debris lying near the opening 18 that the explosive device created is also shown. The opening 18 is defined by an irregular surface against which the external surface of the barrier 22 can press to block and, preferably, seal the opening 18. A sealant 24 can be added to the barrier 22 by spraying a layer of polyurethane foam between the barrier 18 and the surface of the wall 12. If desirable, the sealant 24 can also be applied between the barrier 18 and the rubble 20. In the alternative to being positioned in the opening 18, the barrier 18 could be positioned in the door 14, window 16, or even interior openings of the structure 10.

Figure 2:
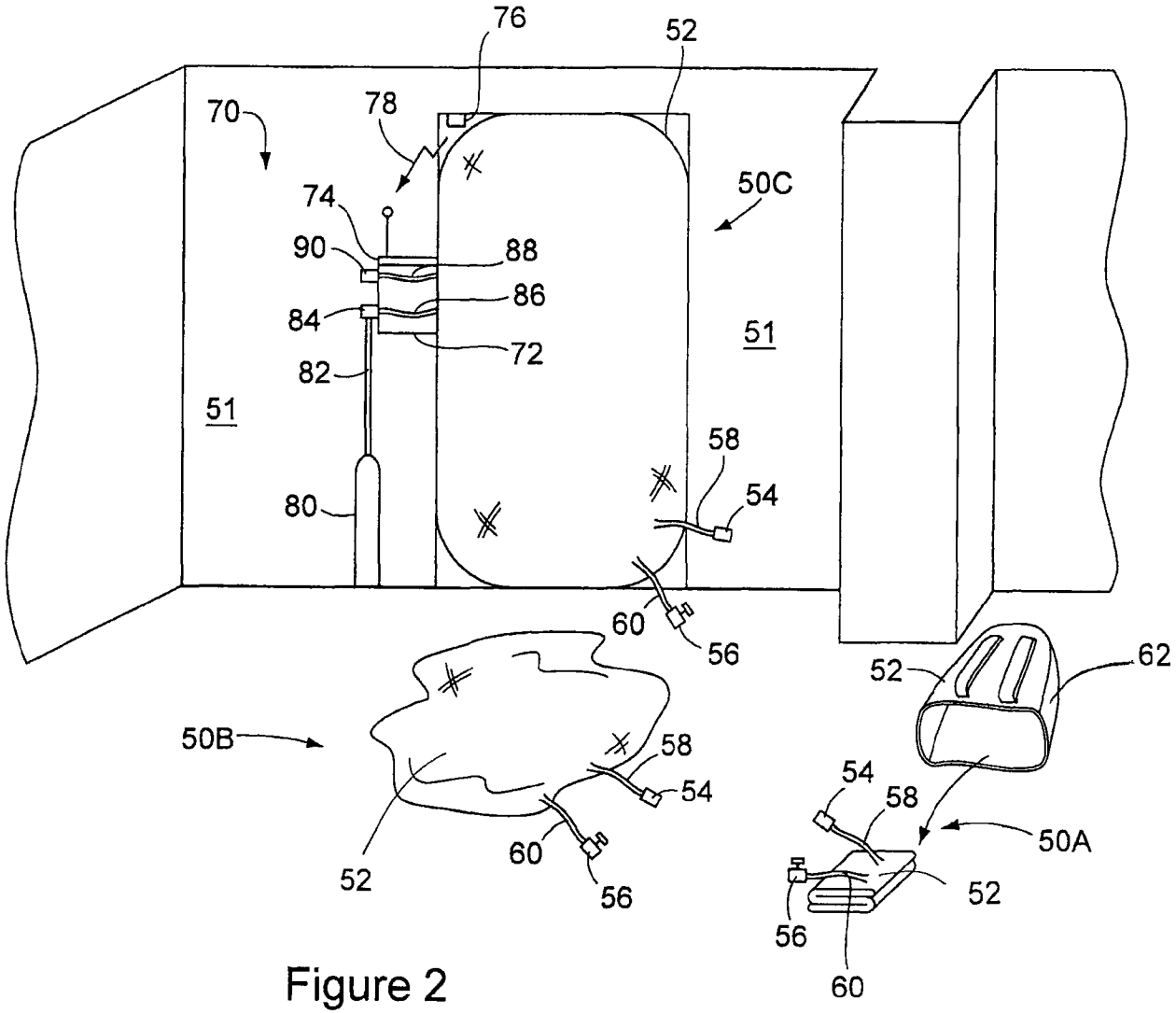
FIG. 2 illustrates a barrier of another preferred embodiment of the present invention.

With reference now to FIG. 2, another preferred embodiment of the present invention is illustrated. The barrier 50 is shown during three stages of its deployment (corresponding to the barriers 50A, 50B, and 50C illustrated in FIG. 2) in an interior region of a building or other structure 51. As shown, the barrier 50 includes a fabric bag 52, a gas source 54, a valve 56, and a pair of hoses 58 and 60. FIG. 2 also shows a device 62 for storing and transporting the barrier 50. In a preferred embodiment, the carrying device 62 is a backpack. The hoses 58 and 60 connect the gas source 54 and the valve 56, respectively, to the fabric bag 52 so that the fabric bag 52 can be inflated and deflated. As shown, the gas source 54 is located outside of the fabric bag 52 and holds enough gas (or a suitable material that can be converted to a gas) to inflate the fabric bag 52. In the alternative, the gas source can be located inside the fabric bag 52 and contains a mixture of sodium azide and potassium nitrate, that is similar to the mixture used to inflate automotive airbags. Of course, an ignition device such as an electric spark generator may be included with the gas source and activated by the user to cause a reaction of the mixture for rapidly inflating the fabric bag 52. This alternative embodiment is particularly useful for situations where it is desired for the fabric bag 52 to remain sealed and to not have external connections such as hoses, tubes, or other plumbing fixtures. Further, with the gas source 54 located inside the fabric bag 52, the fabric bag 52 protects the gas source 54 from damage and tampering. Preferably, the gas source 54 and the fabric bag 52 are sized relative to one another such that the gas source 54 can inflate the fabric bag 52 in about 3-6 seconds and, more particularly, in about 3-4 seconds. The valve 56 may, likewise, be sized to allow the fabric bag 52 to deflate in a matter of seconds particularly if the user assists in deflating the fabric bag 52 by compressing it.

In operation, the user carries the barrier 50 to the site where it is desired to block a route through the structure 51. Here, the barrier 50 is shown being deployed to block a hallway, although the barrier could be used to block any route through the structure 51 (such as a doorway, or a crawlspace). At the deployment site, the user removes the barrier 50 from the backpack 62 in a folded, compact configuration that is shown as barrier 50A. If desired, the user can unfold or unfurl the barrier 50 as shown at barrier 50B and can even lay the barrier 50B substantially flat on the floor or ground. Either way, the user activates the gas source 54 and causes the gas to flow through the hose 58 to the fabric bag 52. Once in the fabric bag 52, the gas begins expanding and pressurizing the fabric bag 52 until the gas supply is depleted or until the fabric bag 52 is constrained by the surrounding structures 51. As the fabric bag 52 expands, it fills and obstructs the hallway through the structure 51 as shown with barrier 50C.

In a preferred embodiment, the hoses 58 and 60 connect to the fabric bag within a few inches of each other. Further, it is preferred that the hoses be several feet in length. As a result, the user can remain behind the structure 51 while placing the fabric bag 52 in the passageway and inflating the fabric bag 52 using the gas source 54. The current embodiment, therefore, is particularly useful for law enforcement, military, and similar uses where it is desirable for the user to remain concealed or protected while deploying the barrier 50. With the gas source 54 and valve 56 near each other, and on one side of the bag 52, the current embodiment prevents a party on the opposite side of the barrier 50 from inflating and deflating the bag 52. Thus, the current embodiment provides a tamper proof barrier 50.

FIG. 2 also shows a system 70 for storing and deploying the barrier 50. The system 70 includes a storage compartment 72, a radio frequency (RF) receiver and controller 74, a sensor 76, (electromagnetic (e.g. RF) signals 78 (shown schematically), a gas "K" bottle 80, gas supply tubing 82, a gas supply valve 84, a gas supply hose 86, a deflation hose 88, and a deflation valve 90. The storage compartment may be built into the structure 51 or can be a fixture of, or even separate from, the structure 51. The storage compartment 72 is sized to hold the fabric bag 52 with the hoses 86 and 88 stowed, preferably, behind or under the fabric bag 52 when the bag is in storage. The front of the storage compartment 72 can be open or covered with a panel to conceal the fabric bag 52 when it is not deployed. If a panel is included, the panel is, preferably, capable of allowing the fabric bag 52 to deploy into the passageway without hindrance or delay. For instance, the panel can be configured to break away from the structure 51 (or the housing of the storage compartment 72). In the alternative, the panel can be connected to the storage compartment 72 by a hinge along the bottom of the panel and latched at the top with a latch that can be forced open by the force of the expanding fabric bag 52.

In any case, the "K" bottle 80 communicates with the fabric bag 52 through the supply tube 82, the supply valve 84, and the supply hose 86. Thus, the position (e.g. open or closed) of the supply valve 84 determines whether the gas (e.g. nitrogen, helium, air, etc.) in the "K" bottle 80 can inflate the fabric, bag 52. In the alternative to an open/closed valve, the supply valve 84 can be a self sealing valve (similar to those used to inflate the evacuation chutes found on many commercial aircraft). Such a self sealing valve 84 acts in a manner similar to that of a check valve allowing the gas to flow into the bag but preventing return flow if the pressure drop across the valve reverses). Likewise, the gas in the fabric bag 52 (when deployed) can communicate with the atmosphere or the surroundings via the deflation hose 90 and the deflation valve 88. Of course, the backpack 52, the gas source 54, the valve 56, and the hoses 58 and 60 may be omitted from the current embodiment without departing from the scope of the present invention particularly if a gas source is located within the fabric bag 52.

The sensor 76 communicates with the controller 74 via the electromagnetic signals 78. In turn, the controller 74 determines whether the information conveyed by the electromagnetic signals 78 indicates whether the barrier should be inflated or deflated. Depending on the electromagnetic signal 78, the controller 74 opens the supply valve 84 (and closes the deflation valve 90) to inflate the fabric bag 52 or opens the deflation valve 90 (and closes the supply valve 84) to deflate the fabric bag 52. Thus, the sensor 76 could be any sensor capable of sensing a condition requiring the blocking (or sealing) of the passageway. For instance, the sensor 76 could be a smoke alarm, hazardous material sensor, radiation sensor, rate of rise fire sensor, burglar alarm, motion sensor, or their equivalents. Manual controls may also be included in the system 70 for operating the valves 84 and 90 or otherwise inflating and deflating the barrier 50.

Once the system 70 is installed, the user may fold the deflated fabric bag 52 and stow it in the storage compartment 72 for subsequent use. If the sensor 76 senses a condition for which the user desires to block the passageway (or the user triggers the system 70), the controller 74 opens the supply valve 84 to deploy and inflate the fabric bag 52. As the fabric bag 50 inflates, it fills the passageway thereby blocking the passageway. Further, the controller 74 can hold the supply valve 84 open to ensure that the fabric bag 52 remains fully inflated and blocking the passageway despite leaks and other gas losses. However, it is preferred that the fabric bag 52 be constructed in such a manner that it is capable of remaining substantially inflated for at least an hour. Thus, one preferred method of fabricating the fabric bag 52 includes lining the fabric bag 52 with a bladder to prevent the gas used to inflate the bag from permeating through the fabric. For embodiments that include the supply valve 84 and the deflation valve 90 and after the condition is cleared, or upon a user initiated command, the controller 74 closes the supply valve 84 and opens the deflation (or exhaust) valve 90. The gas in the fabric bag 52 then vents through the deflation valve 90 and causes the fabric bag to begin collapsing. Of course, a vacuum pump or fan could be connected to the deflation valve 90 to increase the rate at which the fabric bag 52 is deflated. In an alternative embodiment, a series of vent holes is provided to allow rapid deflation of the fabric bag 52. In any case, the weight or elasticity of the fabric bag 52 (and, optionally, the user) can assist in expelling the gas from the fabric bag 52. Once the fabric bag 52 is deflated enough to fit into the storage compartment 72, the bag 52 can then be stowed for later use with (optionally) a panel placed in front of the storage compartment 72.

Figure 3:
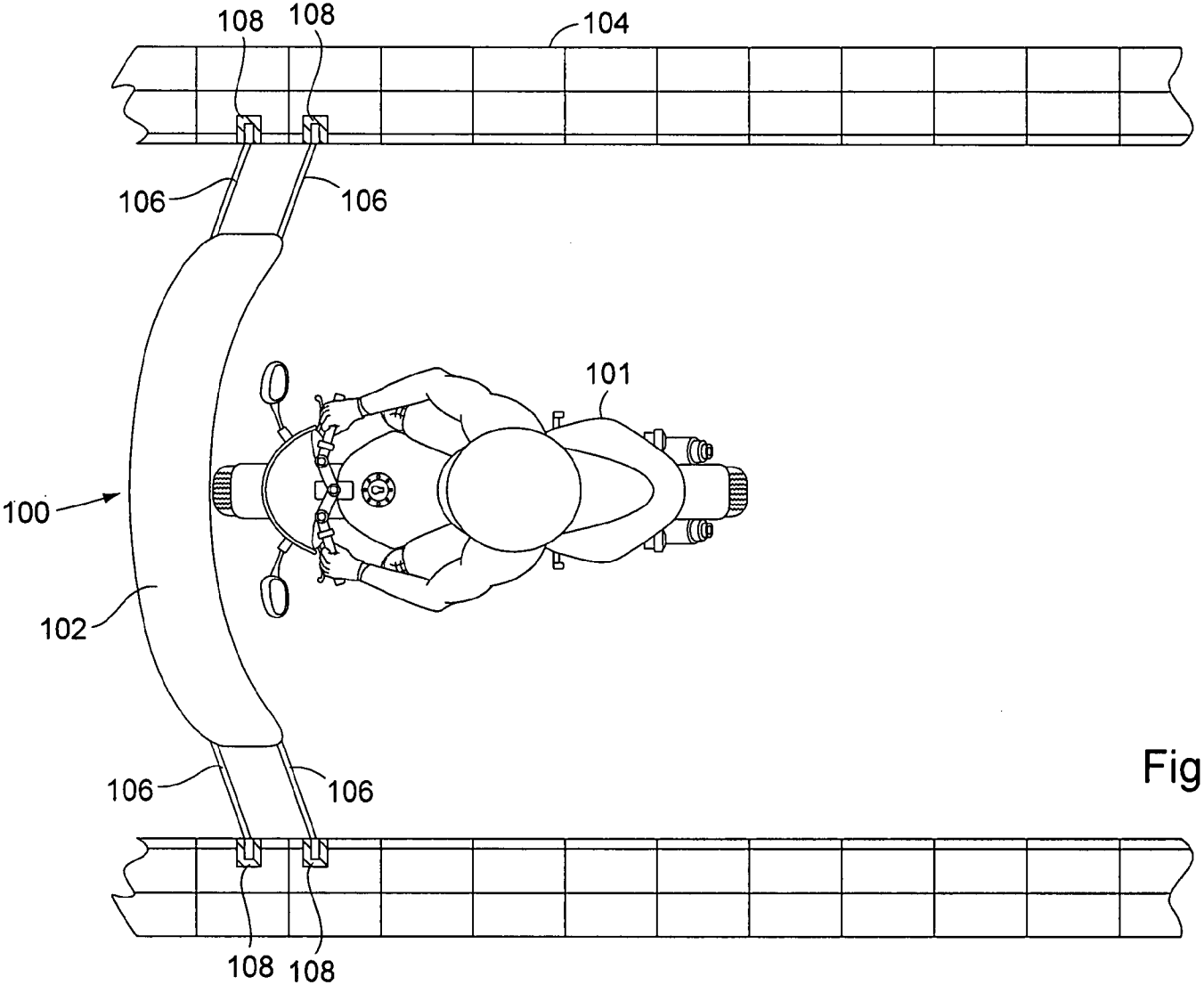
FIG. 3 illustrates a barrier of yet another preferred embodiment.

With reference now to FIG. 3, another preferred embodiment of the present invention is illustrated. The barriers 100 of the current embodiment may be used to obstruct the movement of personnel, bicycles, motorcycles, and other light vehicles 101. The barrier 100 includes a fabric bag 102 and is connectable to a structure 104 (e.g., walls) via a set of chains, ropes, cables 106, or their equivalent restraints. Furthermore, a set of anchors 108 for the cables 106 can be pre-positioned in the walls 104 or can be included with the barrier 100 for insertion in the wall at any desirable time. Preferably, the anchors are RAMSET™ anchors (available from Illinois Tool Works Inc. of Glenview, Ill.) that allow the cables 106 to be connected to the walls 104 even if the walls 104 predate the barrier 100. Accordingly, to use the barrier 100, the user installs the anchors 108 in the walls 104 and connects the cables 106 of the barrier 100 to the anchors 108. The user inflates (erects) the barrier 100 between the walls 104 near the point at which it is desired to obstruct the vehicle 101. If the vehicle 101 subsequently attempts to force its way through the barrier 100, the vehicle will encounter the fabric bag 102 and draw the fabric bag 102 and the cables 106 taut thereby being stopped by the barrier 100.

Figure 4:
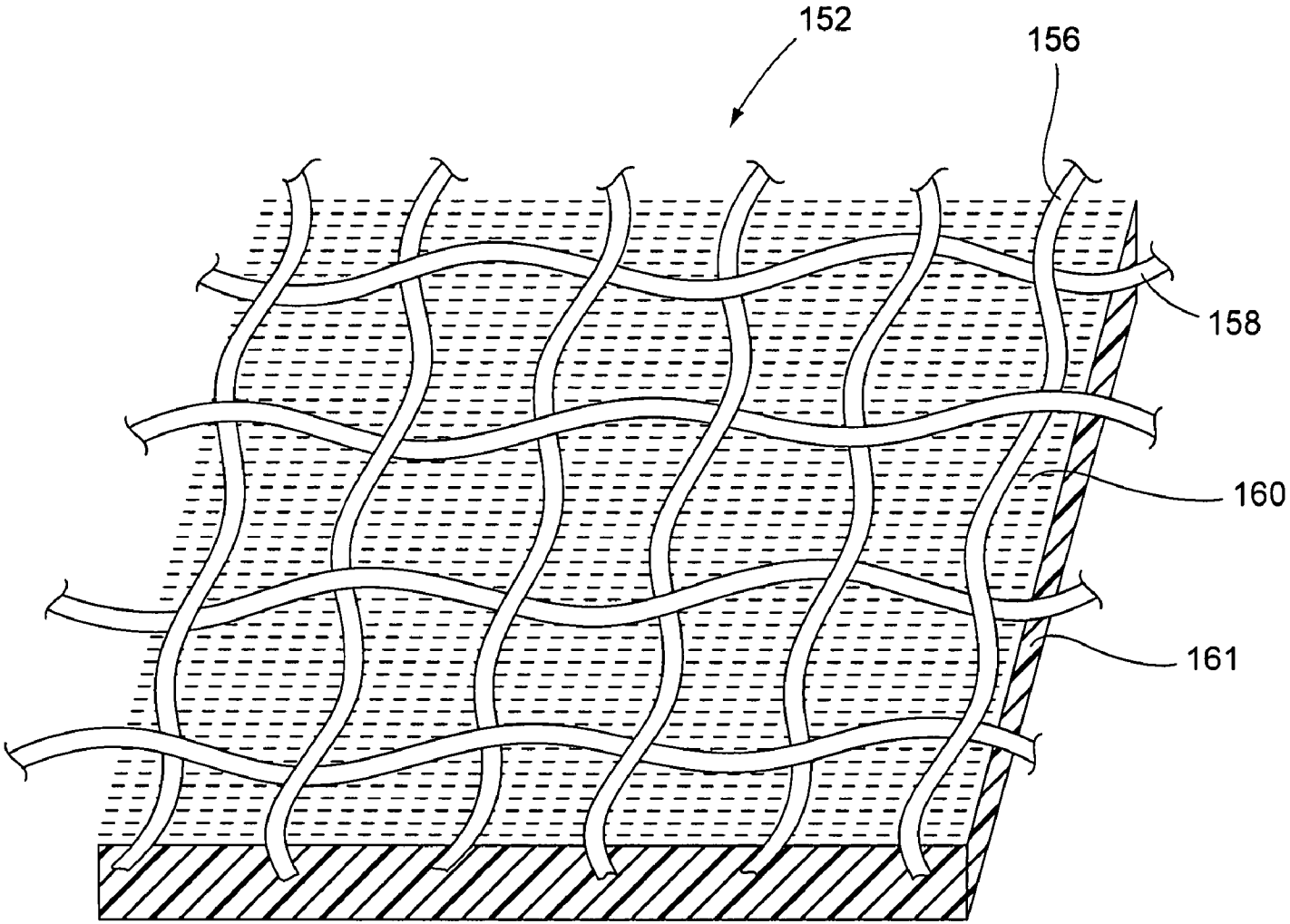
FIG. 4 illustrates a preferred fabric of the barriers of FIGS. 1 to 3.

Another preferred embodiment shown in FIG. 4 incorporates a shear thickening fluid in the fabric of the bag. The shear thickening fluid imparts to the bag the ability to resist cuts, punctures, and other penetrations due to, for example, deliberate attempts to damage or destroy the barrier. FIG. 4 illustrates such a fabric bag 152. The fabric bag 152 includes threads, filaments, or their equivalents 156 and 158 running in, respectively, the warp and weft directions of the fabric bag 152. FIG. 4 shows only one layer of the fibers 156 and 158 although it is possible to form fabric bags 152 with many layers of the fibers 156 and 158. Of course, the current embodiment is not limited to woven fabrics. Rather, any fabric that is capable of retaining the shear thickening fluid and enabling the shear thickening fluid to change state is within the scope of the current embodiment. KEVLAR® fabric is a preferred material with which to form the fabric bag 152, although Neoprene, VECTRAN®, and other materials could be used to form the fabric bag 152.

In between the threads 156 and 158, a shear thickening fluid 160 permeates the fabric bag 152 and is held in place by the fabric bag 152. Preferably, the shear thickening fluid 160 is polyethylene glycol with nano scale particles of silica suspended therein. If low rates of shear are applied to the fabric of the fabric bag 152 (e.g. the fabric is re-positioned or inflated) the nano particles flow freely with the shear thickening fluid 160. But if shear is rapidly applied to the fabric bag 152 (as when, for example, a bullet, knife, or scissor blade attempts to pierce the fabric bag 152), it is believed that the nano particles are unable to move rapidly with the fluid 160 in reaction to the rapid shear. As a result, the nano particles form structures in the fabric bag 152 that cause the fabric bag 152 to become inflexible and capable of resisting the applied shear. Accordingly, if the person being restrained (or others) by the barrier 150 attempts to cut, pierce, or otherwise damage the barrier 150, the shear thickening fluid 160 causes the barrier 150 to stiffen and resist the damage. For more information regarding shear thickening fluids, the reader is referred to Johnson, Tonya, "Army Scientists, Engineers Develop Liquid Body Armor," Army News Service, Apr. 21, 2004. FIG. 4 also shows a bladder or inner tube 161 that lines the interior surface of the fabric bag 152. The bladder 161 serves to prevent the gas (which inflates the fabric bag 152) from escaping through pores in the fabric bag 152. In this manner, the fabric bag 152 can remain inflated indefinitely. Preferably, the liner 161 is an elastomeric material so that it can stretch during inflation to allow the fabric bag 152 to wedge itself against surrounding structures. Furthermore, the bladder 161 can be attached to the interior surface of the fabric bag 152 with, for example, an adhesive.

Figure 5:
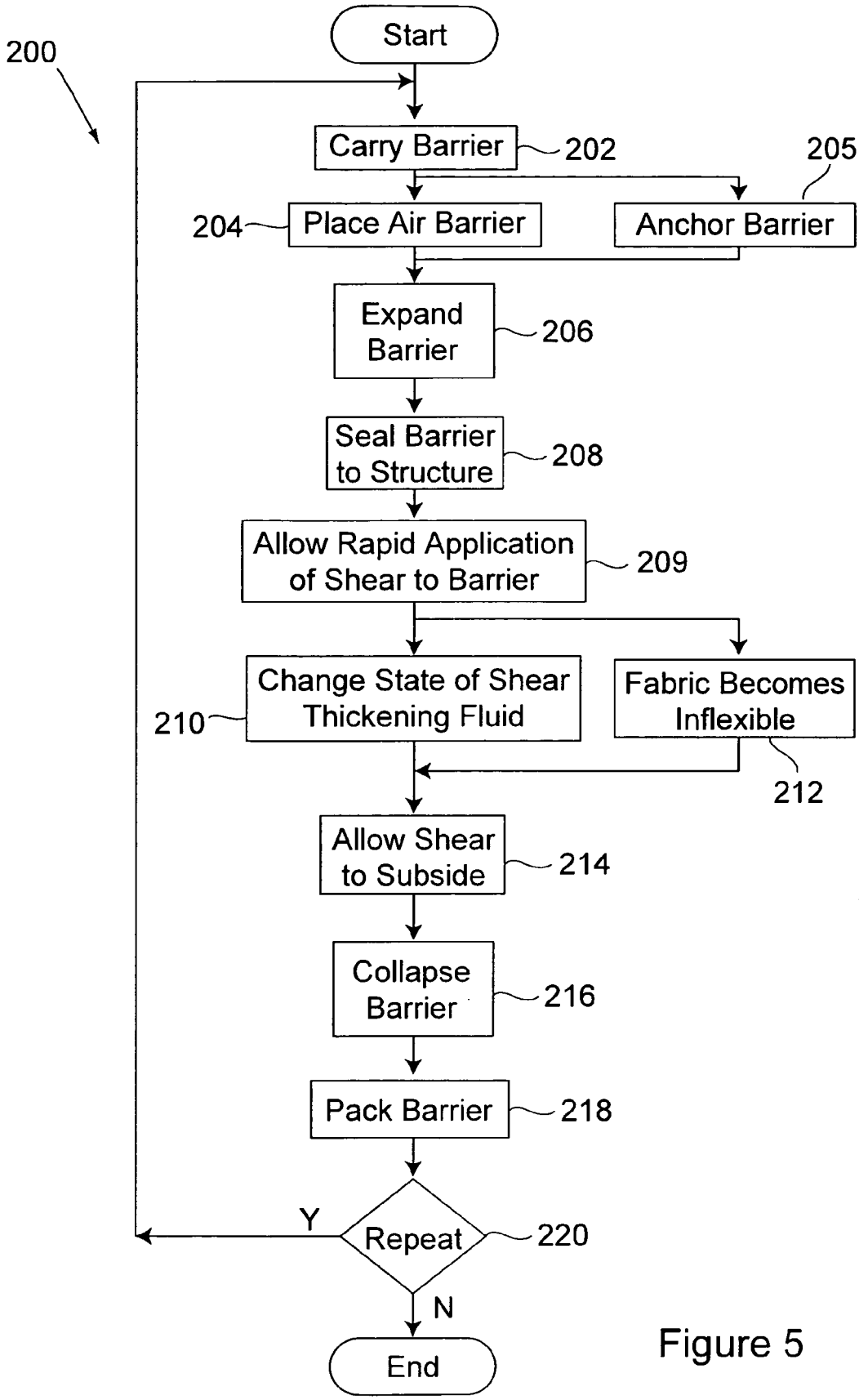
FIG. 5 illustrates a method in accordance with the principles of the present invention.

Now with reference to FIG. 5, a method in accordance with the principles of the present invention is illustrated. The method 200 includes carrying a barrier such as those shown in FIGS. 1-4 to a location where it is desired to obstruct a path. See operation 202. The barrier is then unpacked (if necessary) and deployed close to the desired location and, preferably, at the desired location (operation 204). Since the barrier will expand as it inflates, its positioning need not be perfect. Rather, the increasing size of the barrier will tend to cause the barrier to expand and block the path even if the positioning is not perfect. Also, in operation 205, the user may anchor the barrier to a nearby structure. In the alternative, the user may depend on the barrier wedging itself against nearby structures as it inflates to secure the barrier in place. Further, when it is desired to actually obstruct the path, the user inflates the barrier in operation 206. If it is also desired to seal the passageway (to, for example, contain a hazardous material) then a seal can be applied between the barrier and the nearby structures as shown at operation 208.

With the path now blocked, it becomes more likely that a hostile force may attempt to damage the barrier in an effort to clear the path. Accordingly, it is likely that at some time, a rapid shear may be applied to the barrier by such means as a party attempting to cutting or shooting at the barrier (as in operation 209). Of course, the rapid shear may come from inadvertent, or accidental, sources also. If so, the shear thickening fluid changes state and causes the fabric of the barrier to become inflexible during the time that the shear acts on the fabric (and in the shear thickening fluid). See operations 210 and 212. As the shear subsequently subsides, in operation 214, the fabric of the barrier returns to its flexible state. At some time, of course, the user may desire to open the path to traffic and therefore deflates the barrier in operation 216. Also, the user can pack (or re-stow the bag for embodiments in which the bag is stowed) the barrier for storage or transportation as illustrated with operation 218. Of course, the user can repeat the method 200 at another (or the same) location. See operation 220.

With reference now to FIGS. 6 to 9, additional preferred embodiments are illustrated. The barriers of these embodiments are also capable of being deployed and re-stowed rapidly. Generally, cords are attached to each of the barriers at one end of the cord and are attached to a fastener at the other end of the cord. The fastener may include an adhesive backing to attach the fastener to nearby structures. Additionally, these embodiments include gas sources that include an explosive mixture of sodium azide and potassium nitrate and that are located within the fabric bag (and bladder) of the barrier.

Figure 7:
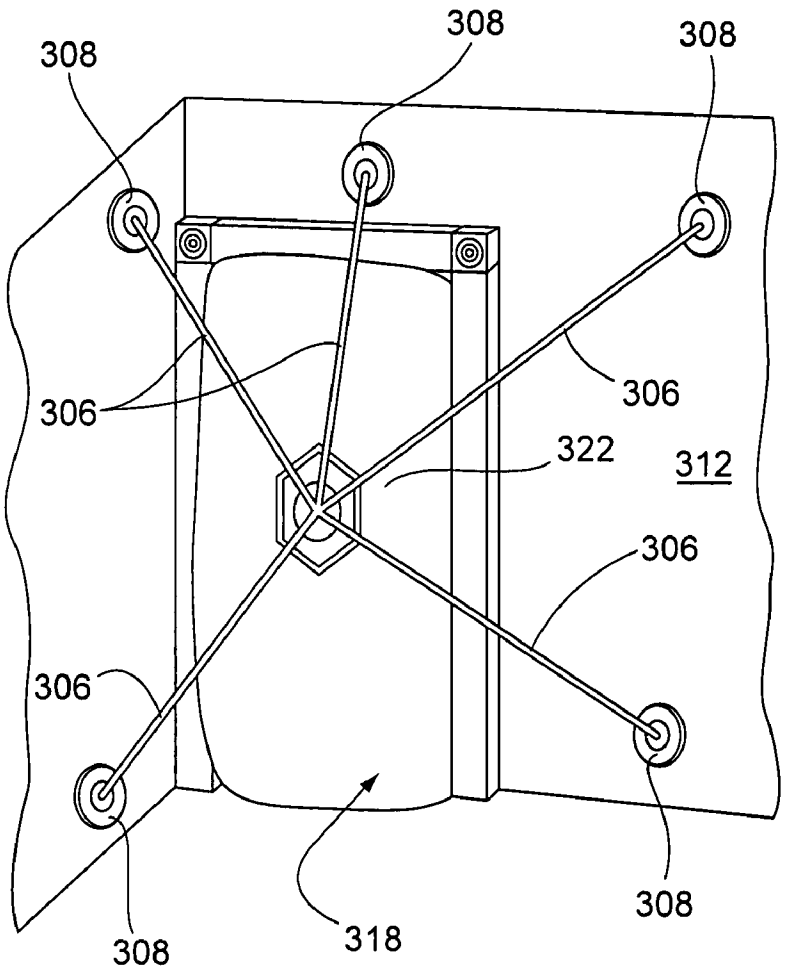
FIG. 7 illustrates the embodiment of FIG. 6 in an inflated condition.
Figure 6:
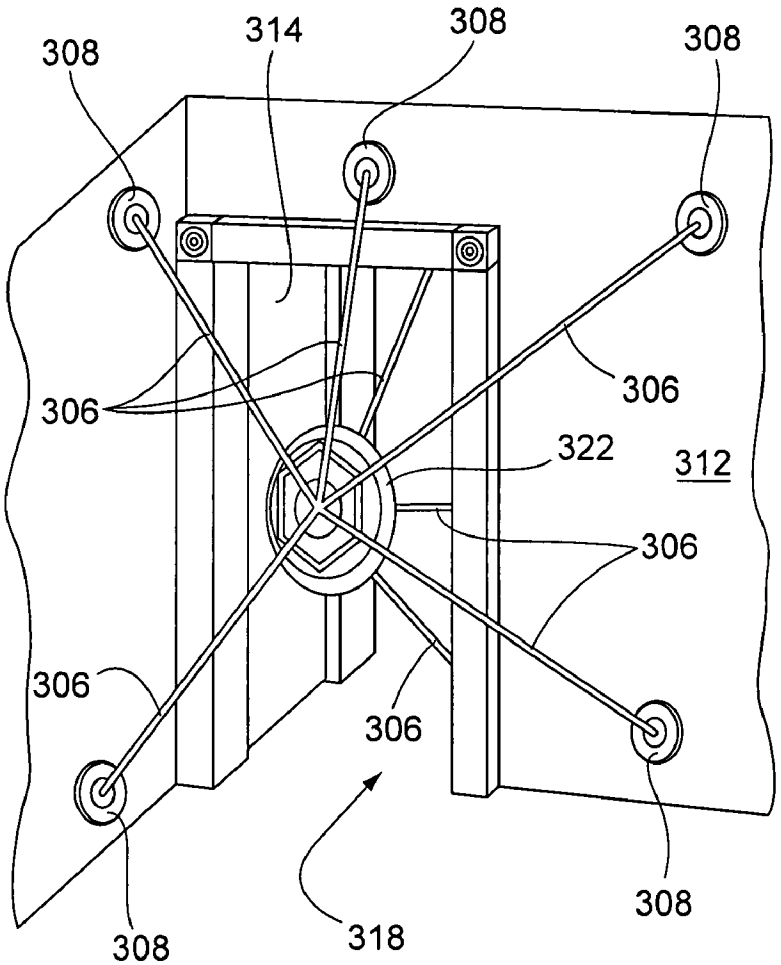
FIG. 6 illustrates another preferred embodiment of the present invention.

More particularly, FIGS. 6 and 7 show a barrier 322 preferred for use in indoor environments. The gas source of the barrier 322 is activated using an RF (radio frequency) signal to initiate the explosion that produces the inflation gas. If desired, the remote RF control (or "key") for a particular barrier 322 can be color coded so that the key for that barrier 322 will not be confused with a key for another barrier.

As shown in FIG. 6, the barrier 322 is initially placed in a portal 318 that the user wishes to block. The Adhesive fasteners 308 are then attached to the surrounding walls 312 as shown with the cords 306 holding the barrier 322 in position. Then the barrier 322 is inflated and wedges itself in the portal 318 due to the gas pressure inside the barrier 322. See FIG. 7. If desired, a sealant is then sprayed around the periphery of the barrier 322 where the barrier contacts the wall 322.

Figure 8:
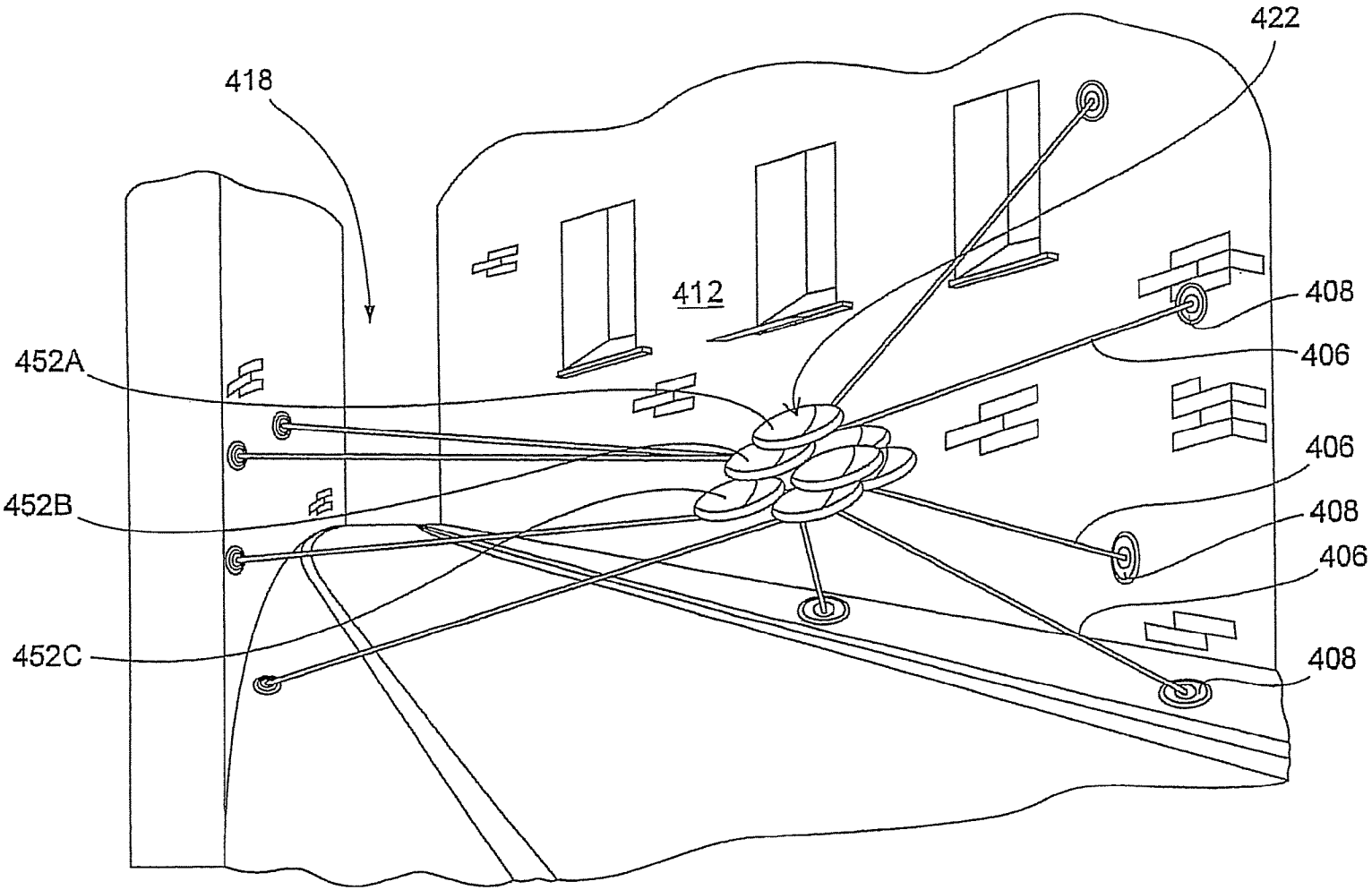
FIG. 8 illustrates another preferred embodiment of the present invention.
Figure 9:
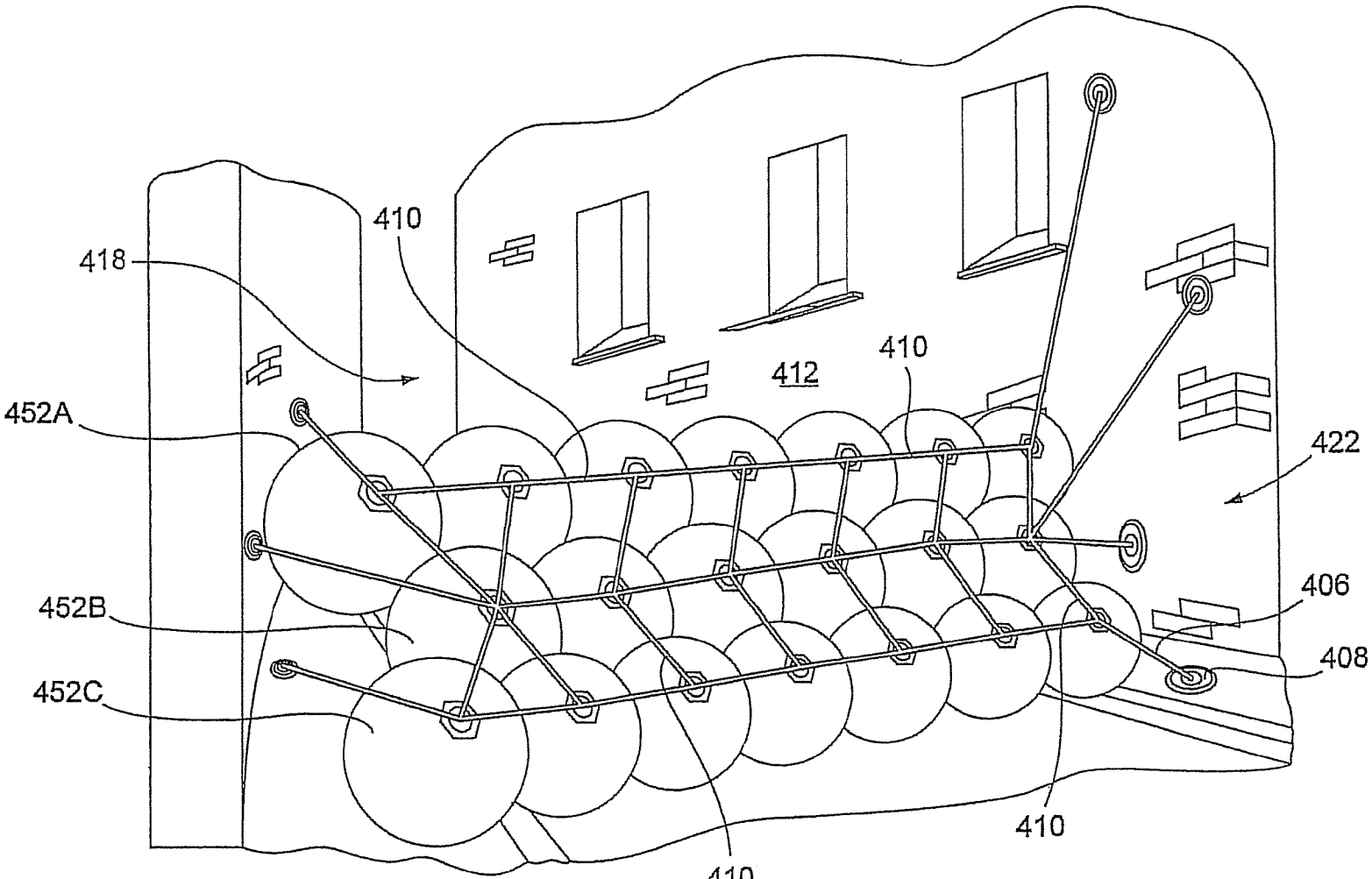
FIG. 9 illustrates the embodiment of FIG. 8 in an inflated condition.

Turning now to FIGS. 8 and 9, a scaled up version of a barrier 422 is shown in, respectively, an un-inflated and in an inflated state. The large barrier 422 is constructed from several inflatable fabric bags such as fabric bags 452A, 452B, and 452C. These fabric bags 452A, 452B, and 452C are secured together with straps 410, cords, stitching or any of their equivalents to form the overall barrier as shown in FIG. 9. The cords 410 are attached to the fabric bags 452A, 4562B and 452C and are configured to define the overall shape of the barrier 422. The embodiment shown in FIG. 9 includes numerous fabric bags 452 connected by cords 410 that are configured to expand to rhomboid, trapezoidal, and triangular configurations. The cords 410 are of a length determined by the center-to-center distances of the fabric bags 452A, 452B and 452C as they are "packed" in the inflated condition. While FIG. 9 shows substantially spherical fabric bags 452A, 452B and 452C, any shape of fabric bag (or combinations thereof) can be used to create barriers 422 of various shapes. Of course, the lengths of the various cords 410 (and the shapes they form) will be determined by the shapes of the inflated fabric bags 452A, 452B and 452C. Again, the barrier 422 is placed in the passageway 418 and secured to the surrounding structures 412 to anchor the barrier in place using anchors 408, as shown in FIG. 8. Each fabric bag 452A, 452B and 452C can contain its own gas source, all of which would be triggered by the same signal. In the alternative, the barrier 422 could be construed from a single bag or with one common inflation source for all of the fabric bags 452A, 452B and 452C. At an appropriate time, the user signals the internal gas sources to inflate all of the fabric bags 452A, 452B and 452C simultaneously. As the barrier 422 inflates it blocks the passageway 418 (shown as being a street or alley) with the cords 410 and anchors 408 holding the barrier 422 in place.

Temporary, or even permanent, barriers in accordance with the principles of the present invention allow the user to obstruct passageways and other apertures in an extremely rapid manner. Moreover, these same barriers can be quickly removed when the desire to obstruct the passageway no longer exists. Furthermore, because the described barriers are light-weight and compact, the user can store and transport the barriers with simple means such as a backpack. Additionally, barriers constructed in accordance with the principles of the present invention are resistant to damage and deliberate attempts to disassemble the barriers.

The described embodiments were chosen to explain the principles of the invention and its practical application to enable those skilled in the art to use the invention in various embodiments and with various modifications as are suited to the particular use contemplated.

As various modifications could be made in the constructions and methods described and illustrated without departing from the scope of the invention, the description should be interpreted as illustrative rather than limiting. For example, the present invention is not limited by the nature of the intended use of the described barriers. In one alternative embodiment, the inflated "barrier" defines an aperture surrounded by the inflated bag. Thus, the user can use the "barrier" to protect an asset from damage or attack. The barriers can be used for either civilian or military applications. Other preferred embodiments include water proof fabric bags that enable the barrier to float. Yet other preferred embodiment use fluids other than the gas produced by the reaction of sodium azide and potassium nitrate to inflate the barrier. One such fluid is compressed air.

Thus, the breadth and scope of the present invention should not be limited by any of the exemplary embodiments, but should be defined only in accordance with the claims.

What is claimed is:

1. A temporary barrier for use with a structure, the barrier comprising:

a bag that is made of a fabric and being expandable with a fluid, the bag further being resistant to puncture and being of dimensions selected to enable the bag to substantially occlude an opening in the structure;

a carrying implement for carrying the bag when the bag is in a folded, compact orientation, the carrying implement having an element enabling the carrying implement to be carried on a body portion of an individual, and the carrying implement having dimensions selected to hold and maintain the bag therein in the folded, compact orientation so that the bag can be deployed from the carrying implement at a location where the bag needs to be implemented;

the bag further including an inflation valve for permitting inflation of the bag and a deflation valve;

a fluid source secured to the inflation valve of the bag and in communication with an interior area of the bag for releasing a fluid into the interior area of the bag to expand the bag;

the deflation valve being in communication with the interior area of the bag to enable the fluid from the fluid source that has been released into the interior area of the bag to be evacuated from the interior area of the bag, and the bag collapsed to its pre-inflated condition without damage to the bag, and the bag able to be re-used by the user; and a shear thickening fluid permeating the fabric of the bag and having a first state in which the shear thickening fluid allows at least a portion of the fabric of the bag to be flexible and a second state in which the shear thickening fluid causes the portion of the fabric of the bag to be inflexible, the first state being characterized by the absence of shear in the shear thickening fluid, the second state being characterized by the existence of shear in the shear thickening fluid.

2. The barrier of claim 1, further comprising a portion of a material that is capable of reacting to produce a gas, the gas forming the fluid used to expand the bag.

3. The barrier of claim 2 wherein the material comprises a mixture of sodium azide, potassium nitrate, and silicon dioxide.

4. The barrier of claim 1, wherein the inflation valve and the fluid source are on the same side of the fabric bag.

5. The barrier of claim 1 wherein the carrying implement comprises a backpack, and wherein the bag is adapted to fit into backpack when the bag is manipulated into a folded condition.

6. The barrier of claim 1 further comprising a radio receiver in electrical communication with the fluid source and adapted to receive a radio frequency command signal, the receiver causing the fluid of the fluid source to be released to expand the bag when the receiver receives the radio frequency command signal.

7. The barrier of claim 1 further comprising a bladder that lines an interior surface of the bag.

8. A method of obstructing an aperture comprising:

providing an expandable and foldable fabric bag;

using a carrying implement to carry the bag when the bag is in a folded orientation, the carrying implement having an element enabling the carrying element to be carried on a body portion of an individual, and the carrying implement being of dimensions to hold and maintain the bag in the folded orientation, so that the bag can be deployed from the carrying implement at a location where the bag needs to be implemented;

using an inflation valve associated with the bag to communicate with an interior area of the bag to permit inflation of the bag;

placing the bag near the aperture, the fabric constructed to be resistant to an external force applied to the bag, and the bag being sized to dimensions substantially similar to dimensions of the aperture when the bag is inflated with a fluid;

expanding an interior area of the bag with the fluid so that the bag substantially obstructs the aperture;

allowing a shear to act on the bag in such a manner that at least a portion of a shear thickening fluid permeating the fabric of the bag transitions from a first state in which the portion of the shear thickening fluid allows at least a portion of the fabric of the bag to be flexible and a second state in which the portion of the shear thickening fluid causes the portion of the fabric of the bag to be inflexible; and using a deflation valve in communication with the interior area of the bag to permit the fluid to be released from the interior area of the bag, and the bag deflated back to an initial, un-inflated configuration, without damage to the bag, so that the bag may be reused.

9. The method of claim 8 wherein the expanding the bag with the fluid further comprises reacting a material.

10. The method of claim 9 wherein the operation of reacting a material comprises reacting a mixture of sodium azide, potassium nitrate, and silicon dioxide.

11. The method of claim 8 wherein the allowing a shear to act on the bag further comprises decelerating a projectile with the bag.

12. The method of claim 11 wherein the projectile is a bullet.

13. The method of claim 8 further comprising sealing the bag against a structure that defines the aperture.

14. A system comprising:

a temporary barrier including:

a bag that is made of a fabric and having an interior area being expandable with a fluid; the bag further being of dimensions to obstruct an opening in a structure;

the bag further being foldable into a compact configuration and having an inflation valve to permit inflation of the bag with a fluid when the inflation valve is opened;

a carrying implement having dimensions for supporting and maintaining the bag in a compact, folded orientation, and for carrying the bag when the bag is in the compact, folded orientation, the carrying implement having an element enabling the carrying implement to be readily carried on a body portion of the user so that the bag may be readily carried to a desired location for use and readily deployed from the carrying implement;

a shear thickening fluid permeating the fabric of the bag and having a first state in which the shear thickening fluid allows at least a portion of the fabric of the bag to be flexible and a second state in which the shear thickening fluid causes the portion of the fabric of the bag to be inflexible, the first state being characterized by the absence of shear in the shear thickening fluid, the second state being characterized by the existence of shear in the shear thickening fluid;

a fluid source adapted to be placed in communication with the inflation valve of the bag to expand the bag;

a sensor in communication with the fluid source and adapted to sense an unsafe condition;

an actuator in communication with the sensor to cause the fluid source to expand the bag with a fluid when the sensor senses the unsafe condition; and the bag further including a deflation valve in communication with the interior area of the bag for allowing the fluid to be released from the interior area of the bag, and the bag collapsed to a pre-inflated condition without damage to the bag so that the bag may be reused.

15. The system of claim 14 wherein the sensor is a fire detector.

* * * * *